US005706748A

United States Patent [19]

Migliorini

[11] Patent Number: 5,706,748

[45] Date of Patent: Jan. 13, 1998

[54] METHOD AND MACHINE FOR SEWING TWO TUBULAR ARTICLES ESPECIALLY STOCKINGS TO FORM PANTYHOSE ARTICLES

[75] Inventor: Pier Lorenzo Migliorini, Terranuova Bracciolini, Italy

[73] Assignee: Solis S.r.l., Tavarnuzze, Italy

[21] Appl. No.: 582,972

[22] Filed: Jan. 4, 1996

[30] Foreign Application Priority Data

Jan. 27, 1995 [IT] Italy ..... FI95A0015

[51] Int. Cl.[6] ..... D05B 21/00

[52] U.S. Cl. ..... 112/470.15; 112/475.12

[58] Field of Search ..... 112/470.08, 470.15, 112/475.12

[56] References Cited

U.S. PATENT DOCUMENTS 4,188,898 2/1980 Bell, Jr. et al. .
4,224,885 9/1980 Takatori .
4,267,785 5/1981 Osho ..... 112/470.08
4,303,026 12/1981 Ueda ..... 112/470.15
4,541,351 9/1985 Horita et al. ..... 112/470.15

*Primary Examiner*—Paul C. Lewis
*Attorney, Agent, or Firm*—McGlew and Tuttle

[57] ABSTRACT

An improved circular carrousel machine is provided for carrying out the joining seam of two tubular articles, especially women's stockings, to form a pantyhose article. The machine includes at least two paired, flat, superposed shapes (1) for supporting the articles (M), and at least a sewing machine (C) provided with a finger (3) and a foot (4) and suitably positioned in a corresponding carrousel sewing station. Each of the shapes (1) is provided, in correspondence of each of its internal edges (11), with an appendix (10) of predetermined length and developed according to the longitudinal direction of the shape (1). The appendix (10) is centripetally oriented with respect to the central longitudinal axis (x—x) of the shape (1) and projecting from the respective edge (11). The front edge (30) of the finger (3) of the sewer is wedge shaped, with its front (30) sloping down in the direction of the incoming shapes (1).

4 Claims, 2 Drawing Sheets

METHOD AND MACHINE FOR SEWING TWO TUBULAR ARTICLES ESPECIALLY STOCKINGS TO FORM PANTYHOSE ARTICLES

FIELD OF THE INVENTION

The present invention relates to a method and an improved machine for sewing two tubular articles, especially stockings, to form pantyhose articles.

BACKGROUND OF THE INVENTION

As it is known to those skilled in the art, in order to make a pantyhose article, it is first necessary to individually fit two stockings onto two paired flat shapes in overlapping relationship and then to line them up vertically close to each other, so as to have correspondence between the elastic hems of the two stockings. Thereafter, the thus positioned stockings must be cut longitudinally, starting from the elastic edge, for a stretch of predetermined length. Then, with the shapes being disposed in a stretched apart condition, the juxtaposed hems of the two thus cut stockings are sewn together to form the pantyhose bodice, the sewing being carried out over the whole cut length or part thereof, after which the shapes are repositioned in the initial condition and the stockings unloaded from the shapes.

The operating procedure set forth above is also described in the documents U.S. Pat. Nos. 4,188,898 and 4,224,885, which disclose several examples of the means for carrying out said procedure, particularly the said shapes for the support of the stockings, the means for driving the shapes, and the means intended to control the opening and respectively the closing thereof.

It is also known that the sewing machines traditionally used in the manufacturing of pantyhose articles comprise a fabric-holding foot which, in operating condition, is positioned above the two hems to be joined, and a horizontally developed element, whose jargon term is "finger", which, in turn, is located below said foot and fixed thereto. For the sewing to be properly performed, the two hems to be joined must result interposed between the foot and the finger throughout the whole operation.

However, with many types of articles, especially stockings, when they are brought close to the sewer, one or both the hems to be sewn may spontaneously move to an overly stretched apart condition, so as to strike the foot and/or finger of the sewer and roll up or pass over it with the result of preventing the correct sewing operation.

SUMMARY AND OBJECTS OF THE INVENTION

The main object of the present invention is to overcome the above mentioned drawbacks.

This result has been achieved, according to the invention, by adopting an operating method for the sewing of the two textile products fitted on corresponding support shapes in relative motion with respect to a sewing machine, in which, during the sewing of the products, provision is made to hold the respective hems to be sewn and guide them across the space delimited by the foot and the finger of the sewer.

As far as the machine to implement the above operating method is concerned, it comprises in combination: —means for supporting the two articles to be sewn, with two paired flat and superposed shapes which, upon the sewing of the articles, are in relative motion with respect to a sewing machine; —means associated to said support shapes, for holding the hems of said articles during the sewing thereof, so as to guide, in cooperation with further means associated to said sewer, the two hems within the space delimited by the sewer's foot and finger.

The advantages deriving from said invention lie essentially in the fact that it is possible to obtain always a complete and proper sewing of the highest quality, being ensured in any case the correct positioning of the hems with respect to the sewer needle upon its operative stage; that it is possible to achieve the highest operating speed allowed by the sewer also for articles of very flexible, elastic and/or wide-stitch fabric, and for cotton articles as well which, in the traditional machines tend to roll up in correspondence of the cut; that a machine in conformity of the invention is of simple construction, of low cost and reliable even after a prolonged life service.

BRIEF DESCRIPTION OF THE DRAWINGS

These and other advantages and characteristics of the invention will be best understood by anyone skilled in the art from a reading of the following description in conjunction with the attached drawings given as a practical exemplification of the invention, but not to be considered in a limitative sense, wherein.

DETAILED DESCRIPTION OF THE PREFERRED EMBODIMENT

Figure 1:
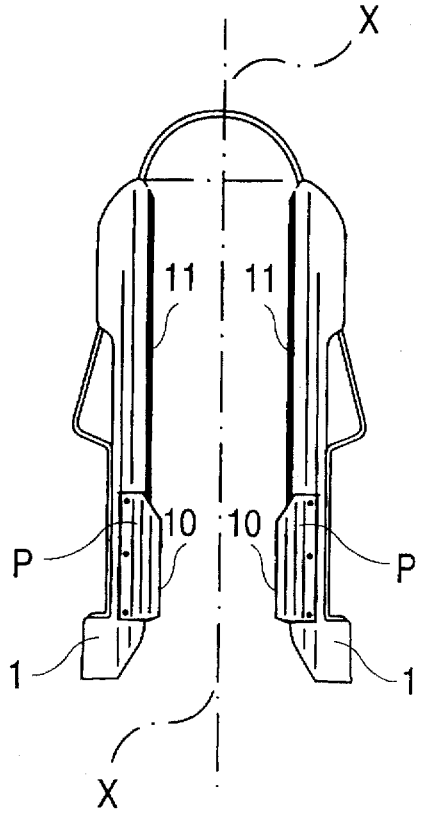
FIG. 1 shows a plan view of a pair of stockings supporting shapes in an apparatus according to the invention.
Figure 2:
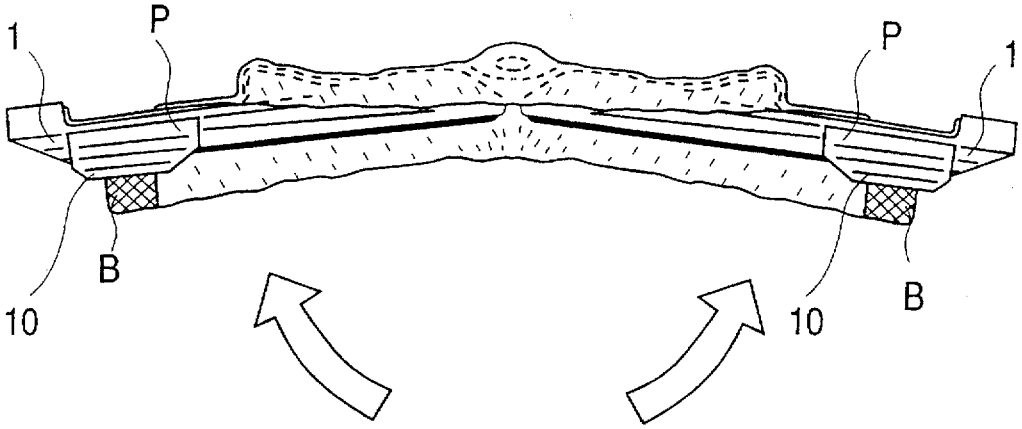
FIG. 2 shows a plan view of the shapes of FIG. 1, in stretched apart condition, in which a pantyhose in the process of formation is viewble from above.
Figure 3:
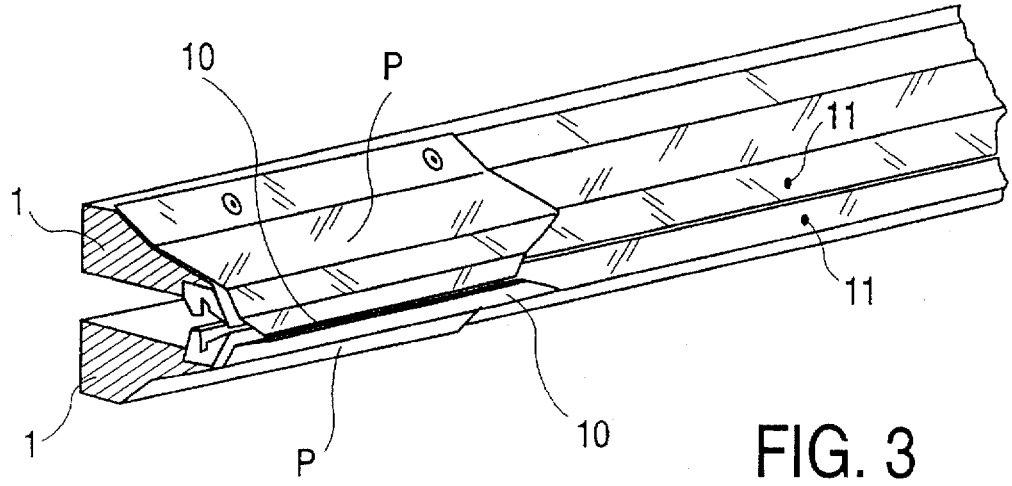
FIG. 3 shows a detail of the shapes of FIG. 1 in partial perspective view.

Reduced to its basic structure and reference being made to the accompanying drawings, a method for carrying out the joining seam of two tubular articles, especially women's stockings, to form a pantyhose article, comprises the steps of fitting each of the two articles (M) onto a corresponding support shape (1) so as to dispose it in a predetermined position onto the shape (1), moving said shapes (1) afterwards close to each other with the articles thus positioned between them, with the hems to be sewn juxtaposed and projecting from the shapes (1), and then moving the shapes (1) to dispose them in correspondence of the needle (5) of a sewing machine (C) to operate the sewing of the juxtaposed hems of the two articles (M) after trimming said hems as necessary.

Advantageously, according to the invention, as a consequence of the shapes (1) moving close to each other, and during the sewing of the hems, the portion of each hem protruding from the respective shape (B) is centripetally oriented with respect to the sewing line to be performed: the hems (1) thus oriented being forced to move forwards up to the needle, by the same shapes (1) moving relative to the sewer, within a channel-shaped guide converging towards said needle, and delimited by the finger (3) and the foot (4) thereof, so that both hems will result interposed between the finger (3) and the foot (4) throughout the sewing operation.

As far as the means for implementing said operating method are concerned, they comprise:

a circular machine of the "Line-Closer" type, with at least two flat, paired, superposed shapes (1) for supporting the articles (M); a machine of this type being described, for example, in the above mentioned documents U.S. Pat. Nos. 4,188,898 and 4,224,885, at least a sewer provided with a finger (3) and a foot (4) and suitably positioned in a corresponding known per se sewing station of the "Line-Closer".

Advantageously, according to the invention and with reference to the figures of the accompanying drawings, each of said shapes (1) is provided, in correspondence of each of its internal edges (11), with an appendix (10) of predetermined length and developed in the longitudinal direction of the shape (1): said appendix (10) being centripetally oriented with respect to the central longitudinal axis (x—x) of the shape (1) and, therefore, projecting from the respective edge (11). Moreover, the front edge (30) of said finger (3) of the sewer is advantageously of wedge shape, with its front sloping down in the direction of the incoming shapes (1), so as to make up, in cooperation with the front edge (40) of the foot (4) associated thereto, a flaring element to ease the insertion—because of the relative movement between the shapes (1) and sewer—of the two hems of the article to be sewn into the space between the finger (3) and the foot (4).

More in particular, the front edge (30) of the finger (3) and, respectively, the edge (40) of the foot (4), delimite a channel-shaped guide converging towards the needle of the sewing machine, said edge (40) resulting above the upper appendix (10) and said edge (30) below the lower appendix (10) of the pair of shapes (1).

Advantageously, in conformity to the invention and reference being made to the figures of the accompanying drawings, said appendix (10) consists of a suitably shaped plate (P) having a side connectable to the shape (1) and the other side being free. The connection of the plate (P) to the shape (1) may be made, for example, by screw means.

The operation of the described apparatus, during the step for the sewing of the articles (M) is as follows. The hems of the articles (M) to be sewn and which are disposed so that the respective free edges will result at a predetermined distance (d) from the corresponding edge of the plates (P), are held adherent to each other by the compression exerted by the closed shapes (1) which are held tight to each other and centripetally oriented by the respective appendixes (10) towards the sewing line to be carried out: in this way, they are prevented from spontaneously moving away from said line. When the front edge—with respect to the diretion of motion—of the thus held and oriented hems results in correspondence of the finger (3) foot (4) assembly, it is guided and directed across the space delimited by the latter two elements, by the combined action of the appendixes (10) which properly orient the hems, and of the walls of the finger (3) and foot (4) which, firstly, intercept the hems projecting from the plates (P) and then guide and keep them within said space, thereby causing them to result constantly and progressively in correspondence of the needle (5) of the sewer (C) in the most suitable condition for a correct sewing.

Figure 4:
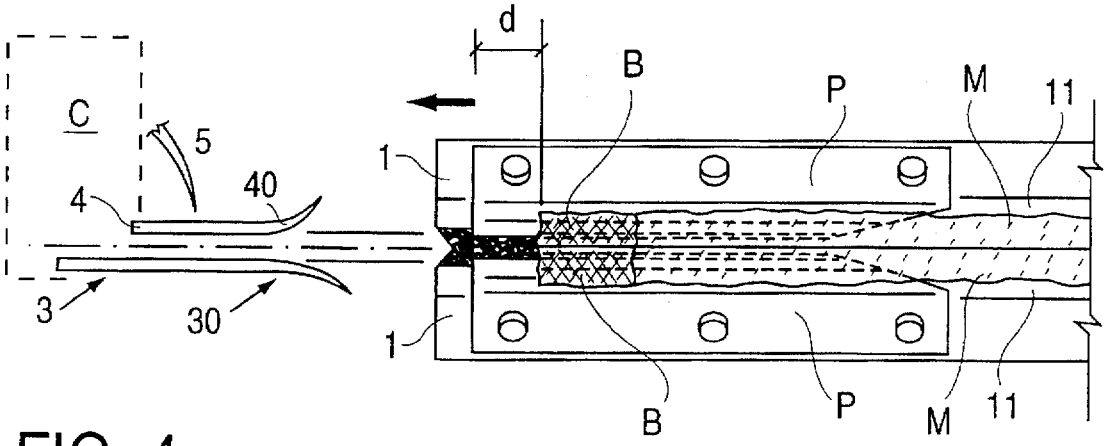
FIG. 4 shows schematically the shapes of FIG. 1 as they move towards the sewer (C)
Figure 5:
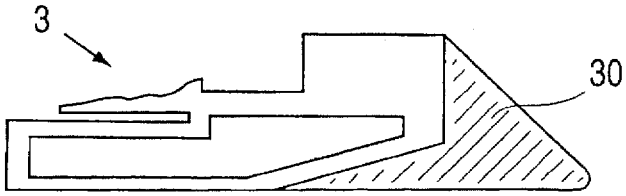
FIG. 5 shows the detail of the finger of the sewer of FIG. 4.

In particular, in the manufacturing of pantyhose articles, reference being made to FIG. 4 of the accompanying drawings for a non limitative example, each of said articles (M) consists of a stocking which is fitted onto the respective shape (1) so that its elastic hem (B) will result at the height of the corresponding appendix (10) a predetermined distance (d) away from the respective free end.

Practically, all the construction details may vary in any equivalent way as far as the shape, dimensions, elements disposition, nature of the used materials are concerned, without nevertheless departing from the scope of the adopted solution idea and, thereby, remaining within the limits of the protection granted to the present patent for industrial invention.

It is claimed:

1. A method for carrying out the joining seam of two tubular articles, to form a pantyhose item, the method comprising the steps of:

fitting each of the two articles onto a corresponding support shapes so as to dispose it in a predetermined position onto the support shape, the articles having hems;

moving one or both said support shapes to position said support shapes close to each other with the articles thus positioned between them, with the hems to be sewn juxtaposed and projecting from said support shapes, to provide juxtaposed hems;

moving said support shapes to dispose said support shapes in a sewing region of a needle of a sewing machine, the sewing machine having a foot and a finger;

trimming said juxtaposed hems as necessary;

sewing said juxtaposed hems of the two articles;

centripetally orienting, with respect to a sewing line to be performed, a portion of each hem protruding from the respective shape to provide oriented hems; and forcing the oriented hems to move forward up to the needle by moving said support shapes relative to the sewer within a channel-shaped guide converging towards the needle, and delimited by the finger and the foot of the sewing machine, so that both hems will be interposed between the finger and the foot throughout the sewing operation.

2. A circular carrousel machine for forming a joining seam of two tubular articles, to form a pantyhose article, the machine comprising:

at least two paired, flat, juxtaposed shapes to support the articles;

a sewing machine provided with a foot and a finger with a wedge shaped front edge and a front sloping down in a direction of incoming shapes, so as to make up, in cooperation with a front edge of said foot a flaring element to ease an insertion of hems of the article to be sewn into a space between said finger and said foot, upon relative motion between said shapes and said sewing device;

a carrousel sewing station, said sewing machine being positioned at said carrousel sewing station;

an appendix provided at an internal edge of each of said shapes, each said appendix having a predetermined length in a longitudinal direction of the shape, each of said shapes being centripetally oriented with respect to a central longitudinal axis of said shapes and projecting from said internal edge.

3. The machine according to claim 2, wherein said front edge of said finger in cooperation with said front edge of said foot delimite a channel-shaped guide converging towards the needle of said sewing machine, with said front edge of said finger and said front edge of said foot being disposed at a higher level than the appendix of an upper shape of said support shapes and with said hem being disposed at a substantially lower level than the appendix of a lower shape of said support shapes.

4. The machine according to claim 2, wherein the said appendix comprises a plate having a side connectable to an associated one of said support shapes and another side free and centripetally oriented towards a central longitudinal axis of the support shapes.

* * * * *